US009081314B2

(12) United States Patent
Kumar

(10) Patent No.: US 9,081,314 B2
(45) Date of Patent: Jul. 14, 2015

(54) METHOD FOR PRODUCING STRUCTURED PARTICLES

(75) Inventor: Abhinava Kumar, Birmingham (GB)

(73) Assignee: Navran Advanced Nanoproducts Development International Pvt. Ltd., Haryama Gurgaon (IN)

( * ) Notice: Subject to any disclaimer, the term of this patent is extended or adjusted under 35 U.S.C. 154(b) by 0 days.

(21) Appl. No.: 13/698,812

(22) PCT Filed: May 6, 2011

(86) PCT No.: PCT/IN2011/000319

§ 371 (c)(1),
(2), (4) Date: Nov. 19, 2012

(87) PCT Pub. No.: WO2011/145107

PCT Pub. Date: Nov. 24, 2011

(65) Prior Publication Data

US 2013/0059248 A1 Mar. 7, 2013

(30) Foreign Application Priority Data

May 19, 2010 (IN) ..... 1164/DEL/2010

(51) Int. Cl.
*G03G 9/097* (2006.01)
*G03G 9/08* (2006.01)

(52) U.S. Cl.
CPC ..... *G03G 9/0804* (2013.01); *G03G 9/0819* (2013.01); *G03G 9/0821* (2013.01); *G03G 9/0823* (2013.01)

(58) Field of Classification Search
USPC ..... 430/137.1, 137.14
See application file for complete search history.

(56) References Cited

U.S. PATENT DOCUMENTS

| | | | | |
|---|---|---|---|---|
| 2008/0160443 | A1* | 7/2008 | Yuasa et al. | 430/110.4 |
| 2009/0136863 | A1* | 5/2009 | Asarese et al. | 430/108.1 |
| 2009/0258308 | A1* | 10/2009 | Park et al. | 430/108.1 |
| 2009/0269690 | A1* | 10/2009 | Morris et al. | 430/105 |
| 2010/0052204 | A1* | 3/2010 | Takagi et al. | 264/113 |

OTHER PUBLICATIONS

Notification of Transmittal of International Search Report and the Written Opinion of the International Searching Authority, or the Declaration for International Patent Application No. PCT/IN2011/00319 (Nov. 16, 2011).

* cited by examiner

*Primary Examiner* — Peter Vajda
(74) *Attorney, Agent, or Firm* — Jenkins, Wilson, Taylor & Hunt, P.A.

(57) ABSTRACT

Method for producing structured particles specifically nanoparticles, toners for laser printers and photocopiers, particularly chemical toner with particular product properties. The method produces toners of improved performance. Method relates particularly to the selection and properties of the base materials and utilizing these properties to design the toner product properties that result in improved performance.

18 Claims, No Drawings

METHOD FOR PRODUCING STRUCTURED PARTICLES

FIELD OF INVENTION

The invention relates method for producing structured particles. The invention also relates to toners for laser printers and photocopiers, particularly methods for making chemical toner (or Polymerized toner, PT) with particular product properties are provided that produce toner of improved performance compared to existing aftermarket toners.

The invention relates particularly to the selection and properties of the base materials and utilizing these properties to design the toner product properties that result in improved performance.

BACKGROUND

Wax is used to provide ability for toner to be fused without the need for silicone oil in the fusion rollers. This is called oil-less fusion. Chemical toner methods allow better control of wax incorporation than mechanical/conventional methods. However, it is still necessary to control the location of the wax within a toner particle. The currently available chemical toners, especially those made through the latex aggregation methods suffer from the problem that it is difficult to control the location of the wax sub-particles within the toner particle.

Fujifilm Imaging Colorants Ltd. (FFIC) and Xerox latex aggregation methods are similar in principle and although they mention the need for wax to be absent from at or near the surface of the toner particle, there is no indication that their process is able to control the location of the wax particle (or for that matter any other sub-component particles). Mitsubishi has overcome this problem to some extent by making the latex around wax seeds and further by forming a secondary layer of wax-less latex during the aggregation process. However, this does not eliminate the possibility of some wax containing latex at or near the surface of the toner particle. This approach can also lead to other problems e.g. suppressing the effect of any charge control agent and/or charge effects coming from the primary latex and colorant.

Even small amounts of wax at or near the surface can cause print quality issues and storage stability issues. As well as the location of the wax sub-particles, it is also desirable to control the location of the other base materials (sub-components). For example, it may be desirable for the charge control agent (CCA) to be near the surface. In some cases it may be desirable to have colorant particles near the surface or away from the surface depending on the tribo-electric behavior of the said colorant particles. There can be up to 6 different latex types in a toner composition. It may be desirable for some of them to be near the surface and some to be away from the surface.

This invention relates to improving the quality of the chemical toner by making structured particle where the component base materials are placed at location, within the toner particle, which result in achieving desirable product features that result in improved toner performance.

DETAILED DESCRIPTION

Method 1: Through Selection and Control of Particle Size and Particle Size Distribution of Component Particles A) Make stable nano-dispersions of the sub-components (by well established methods known in the art). These are described in a later section.

B) Design the particle size and particle size distribution of the components.

C) These nano-particles are brought together by methods well known in the art for destabilizing the stable dispersions e.g. by heat, flocculating agents (usually multivalent metal salts), oppositely charged stabilizing surfactants, pH etc. We are utilizing microwave to provide the heat for the destabilization event (flocculation/aggregation) to occur. We have chosen microwave as it allows precise control of the heat and therefore the aggregation and therefore the eventual toner particle size distribution. Also, the way we are applying the microwave radiation is more energy efficient and completely safe. As far as we have searched, we are the first to apply microwave flocculation in the Chemical Toner field.

D) This method is claimed for the system where the sub-components are stabilized by the surfactant(s) of similar functionality. We have found that the mean size and size distribution of a component in relation to the size and size distribution of other component(s) determines the eventual location of that component in relation to the location of the other components. For example, we have found that by having a wax particle size which is correlated to the size of the other components, we are able to place the wax towards the center of the PT particle. In a similar manner, we are able to select and design the size and size distribution of all the components such that they are inter-related and thus are placed at precise locations when the destabilization event occurs.

E) Furthermore we have found that it is the toner particle density, instead of bulk density, tapped density reported in prior art definition of particle density, and the particle density's relation to its size and shape affords enhanced quality attributes that are lacking in currently available toners. We are able to control the particle density of the toner primarily through the properties of latex components and control of the size distribution of all the components. Bulk density and tapped density are the density including voids inside particles and voids between particles. Particle density is the density of toner particles including voids inside particles and excluding voids between particles. We have been able to adjust the particle density by being able to adjust the voids inside the particles.

F) Good control over raw material particle size and particle size distribution is important to achieve good control over PT particle size distribution.

G) We found that it is important to control the properties of raw materials because some characters of structured particles may experience similar changes to that of raw material particles when going through the same processing. For example, if latex particle size changes when they are heated or their pH is adjusted, PT particles made of the latex may experience the same changes during the processes. For example, we are able to make latex that results in a toner that shrinks slightly during consolidation and shape control stages. We utilize this feature not only to improve the performance of the toner but also for process control of those stages.

Method 2: Sequential Aggregation

Although Method 1 produces toners of high quality, we have proven an additional method that gives further flexibility in the design of the structured particle.

A) Stable nano-dispersions are produced as in Method 1.

B) Sequential flocculation/aggregations are carried out to place the components at the appropriate locations, e.g. wax is flocculated first, then other components are flocculated on 'top' of the flocculated wax particles so that wax is placed at the center of the eventual toner particle. By this method, a layered particle structure is possible.

Method 3: Combination of Method 1 and Method 2

A) By combining Method 1 and Method 2 we achieve further control and flexibility in achieving the desired structured particles.

The description above relates to the composition and internal structure of the unformulated toner particles i.e. prior to any optional blending of flow additives.

The external structure or surface composition/structure achieved following blending of flow additives is equally important in determining the quality of the toner. The three key toner properties that are impacted by the blending of flow additives are tribocharge, powder flow and surface coverage.

Toner particle density plays a key role in the flow behavior of the toner particles. Another key property of the toner particle that affects the flow additive blending process is the hardness of the toner particle. If the toner particle is too hard then the flow additives are not suitably attached to the toner particle as they tend to 'bounce' off the hard surface. Even if there is a degree of attachment due to electrostatic charge, the flow additives can detach from the surface upon storage and cause print quality issues (e.g. white spots, due to lose flow additive particles stuck on the OPC drum). If the toner particle is too soft, then the flow additives become embedded and submerged in the toner particle losing their effectiveness. Although, the use of a combination of small and large particle size flow additives is recommended (by flow additive suppliers) to combat this problem, in practice it is difficult to overcome the embedding problem.

This invention overcomes this problem by designing the hardness of the toner particle to ensure that the flow additives are attached properly without excessive embedding. We define the toner hardness by a nano-indentation technique—this technique utilizes AFM (Atomic Forced Microscopy) and involves measuring the distance travelled by the AFM probe in the toner particle for a given applied force. We have found that that toners with a nano-indentation value of less than 5 nm (nanometers) are too hard and those greater than 2000 nm are too soft. We have found that toners with a nano-indentation value between 5 and 2000 nm and particularly between 10-500 nm show good attachment of flow additives. The toner hardness is achieved particularly by the choice of latex sub-components.

For a toner to perform well the three external properties (tribocharge, flow and surface coverage) have to be optimized. These three properties are inter-related. Tribocharge is measured by standard 'blow-off' technique, powder flow is measured by the percentage passage of toner particles through a series of fine sieves (as in the 'Hosokawa Powder Tester'), and surface coverage is measured by the image analysis of the Scanning Electron Microphotographs of the toner particles.

Tribocharge is a measure of the contribution of charge from the exposed flow additives attached to the toner particles and the exposed toner surfaces. Flow additives contribute to the tribocharge value whereas CCA contributes to the tribocharge value as well as the charging rate. Other subcomponents, e.g. latex and colorant, also contribute to the tribocharge value. It is therefore essential that the toner surface is not fully covered with the flow additives and that a certain percentage of the toner surface is exposed. The flow properties are mainly affected by the amount of flow additives, surface coverage and blending conditions (blender speed and residence time). We have determined that the following combination of the three external properties results in toner of good quality: Tribocharge of −1 to −20 □C/g (for negatively charged toners), +1 to +20 □C/g (for positively charged toners), Surface Coverage of 10%-80% (preferably 20% to 70%) and Flow Number (% Passage) of 60% to 100% (preferably 70% to 98%).

Particle Density Measurement.

Particle density is defined as the density of particles that includes the voids within particles and excludes the voids between particles. PoreMater 33 manufactured by Quantachrome, that uses mercury to fill the void between particles, is used to measure the particle density of toner particles. The true density of toner particles are also measured using Micro Ultrapycnometer 1000 manufactured by Quantachrome using helium to penetrate into the voids within particles.

Wax Dispersion Process 1.

Wax emulsion can be prepared by phase inversion method by first adding mixture of at least one type of wax such as carnauba and/or candellila and surfactant with weight ratio of say 8 to 1 into a vessel. Raise the temperature of the vessel to a temperature above the melting point of the wax mixture say 92 C. A mixture of de-ionized water and surfactant with weight ratio of say 25 to 1 is added into the vessel with melt wax mixture for say one hour. The amount of the water/surfactant mixture added to the vessel is determined by desirable total solids content say 20%. During the process temperature is kept constant with continuous agitation for 30 minutes after completing the addition of water-surfactant mixture before the vessel is cooled to room temperature for discharging the wax emulsion. Depends on the selection of surfactant, pH of the mixture may need to be controlled at certain value. The typical mean particle size of wax in the emulsion prepared by the method is 800 micron.

Wax 1a had a mean size of 120 nm

Wax 1b had a mean size of 405 nm

Wax 1c had a mean size of 628 nm

Wax Dispersion Process 2.

Add at least one type of wax such as carnauba and/or candellila, surfactant and de-ionized water at weight ration of say 20:5:75 into a vessel. Depends on the selection of surfactant, pH of the mixture may need to be controlled at certain value. Turn on an agitator in the vessel. Raise the temperature of the vessel to a temperature above the melting point of the wax mixture say 92 C. Keep agitation for 30 minutes. Circulate the mixture with a high pressure homogenizer in the re-circulation line for 30 minutes. The processing pressure of the homogenizer is 150 MPa. And the flow rate is selected such that the total volume in the vessel is turn over say three times. Stop the recirculation and cool the vessel temperature down to room temperature before discharging the wax emulsion. The typical mean particle size of wax in the emulsion prepared by the method is 400 micron.

Wax 2a had a mean size of 125 nm

Wax 2b had a mean size of 371 nm

Wax 2c had a mean size of 650 nm

The waxes used in the invention can take the form of natural organic waxes, synthetic organic waxes, and silicone waxes. They may include esters of high molecular weight carboxylic acids and higher molecular weight alcohols, paraffinic waxes, hydrocarbon waxes, natural plant waxes, and synthetic waxes. The natural waxes examples are beeswax, spermaceti, hydrogenated castor oil wax and hydrogenated oils. Plant waxes include candellila, carnauba, orange-peel wax, Japan wax, montan wax and bayberry wax.

Pigment Dispersion Process 1

The mixture of yellow pigment, charge agent, surfactant and de-ionized water at weight ratio of 19:7:3:71 are prepared. Some anti bio-degradable agent can also be added into the mixture. The mixture is process by a high shear device for 10 minutes to achieve homogeneity. In a batch ball mill, fill 50% volume of each milling chamber with beads with particle size of say 0.6 to 0.8 micron. Fill the chamber with pigment mixture with 20% open space in each milling chamber. Operate the mill for 3 hours. Discharge the mixture from milling chamber and separate the mixture from beads. The mean particle size of the pigment mixture is measured to be 180 nanometers.

Pigment Dispersion Process 2

The mixture of black pigment, surfactant and de-ionized water at weight ratio of 21:3.5:75.5 are prepared. Some anti bio-degradable agent can also be added into the mixture. The mixture is process by a high shear device for 5 minutes to achieve homogeneity. In a batch ball mill, fill 50% volume of each milling chamber with beads with particle size of say 0.6 to 0.8 micron. Fill the chamber with pigment mixture with 22% open space in each milling chamber. Operate the mill for 2.5 hours. Discharge the mixture from milling chamber and separate the mixture from beads. The mean particle size of the pigment mixture is measured to be 120 nanometers.

Pigment Dispersion Process 3

Five hundred liters of the mixture of magenta pigment charge agent, surfactant and de-ionized water at weight ratio of 18:6:4:72 are prepared in a vessel with agitator and cooling jacket. Some anti bio-degradable agent can also be added into the mixture. The mixture is process by a high shear device installed in the vessel for 10 minutes to achieve homogeneity. Circulate the mixture with a high pressure homogenizer in the re-circulation line for 60 minutes. During the 60 minutes, cooling water in used to maintain vessel to be at room temperature. The processing pressure of the homogenizer is 180 MPa. Discharge the mixture from the vessel. The mean particle size of the pigment mixture is measured to be 190 nanometers.

Pigment Dispersion Process 4

Five hundred liters of the mixture of cyan pigment surfactant and de-ionized water at weight ratio of 23:4:73 are prepared in a feed vessel with agitator and cooling jacket. Some anti bio-degradable agent can also be added into the mixture. The mixture is process by a high shear device installed in the vessel for 10 minutes to achieve homogeneity. Transfer the mixture to a continuous bead slurry mill such as LMZ ZETA mill from Netzsch and FrymaKoruma Stirrer Bead CoBall from Romaco. The processed material is sent to a product vessel. Chill water of 8 C is used in feed vessel and the mill to keep process temperature below 20 C. Stop the process after the mixture is processed by the mill by 15 times. The mean particle size of the pigment mixture is measured to be 175 nanometers.

Latex

Latex was manufactured by conventional emulsion polymerization process. The monomers comprised of Styrene (72-85%), Butyl Acrylate (10-22%) and 5% of minor components including hydroxyl functional monomers and acrylic ester monomers. Varying levels of standard thiols was used as the Chain Transfer Agent (CTA) to control the molecular weight of the latex. Ammonium persulphate was used as the initiator and proprietary ionic surfactant was used as the emulsifier.

Latex 1: Mean particle size 101 nm, Weight Averaged Molecular Weight (Mw) of 24,500, Number Averaged Molecular Weight (Mn) of 7,300.

Latex 2: Made in similar manner to Latex 1 except that minor components included acrylic acid and methacrylic acid. Mean particle size of 98 nm, Mw 22,000, Mn 7,500

Latex 3: Made in similar manner to Latex 2 but with reduced amount of CTA. Mean particle size of 105 nm, Mw 120,000, Mn 23,000

Latex 4: Made in similar manner to Latex 3 but with further reduced amount of CTA. Mean particle size of 110 nm, Mw 550,000, Mn 70,000

Toner

Toner 1: 86 parts latex, 6 parts wax, 6 parts colorant and 2 parts CCA were mixed together with 22 liters of de-ionized water in a 50 Liter reactor containing proprietary agitator providing low shear uniform mixing. The dispersion was mixed at ambient temperature. The dispersion was then heated to the cloud point of the system surfactant to initiate nucleation (flocculation). Following nucleation, the mixture was optionally heated to the glass transition temperature (Tg) of the latex being used (if higher than the cloud point of the surfactant). The nucleated mixture was held at this temperature for 2 hours to consolidate the formed toner particles. The dispersion was then further heated to and held at a temperature higher than Tg to carry out shape and morphology control. Following this step the mixture was cooled, filtered, washed and dried to obtain dry toner powder. The toner was then blended with flow additives in a high energy blender to achieve a functional formulated toner. The resulting toner had a mean size of 8.2 microns (micrometer) with a ratio of the volume mean particle size (d50v) to number mean particle size (d50n) being 1.45.

Toner 2: A toner as in Example 1 was prepared except that the heating to the cloud point of the surfactant was achieved by passing the dispersion mixture through an external flow loop containing the microwave device. The resulting toner had a mean size of 7.9 microns (micrometer) with a ratio of the volume mean particle size (d50v) to number mean particle size (d50n) being 1.19.

Lower d50v/d50n ratio means narrower distribution resulting in better the quality of the toner. The example shows the benefit of carrying out the nucleation by microwave in an external flow loop.

Toner 3: A toner as Toner 2 was prepared with Latex—L1 and Wax—1a.

Toner 4: A toner as Toner 2 was prepared with Latex—L1 and Wax—1b.

Toner 5: A toner as Toner 2 was prepared with Latex—L1 and Wax—1c.

Image analysis of slices of Toner 3, Toner 4 and Toner 5 by Transmission Electron Microscope (TEM) showed wax domains in Toner 3 to be evenly distributed throughout the toner with a mean size of 0.5 microns, whereas, for Toner 5, the wax was concentrated towards the center of the toner particles with a mean size of 2.6 microns. For Toner 4, the wax mean size was 1.6 microns and the wax was less evenly distributed than Toner 3 but not as centralized as in Toner 5. These toners were also tested in a commercially available printer. Following table shows the results:—

| | Toner 3 0 | Toner 4 0 | Toner 5 0 | Toner 3 4 | Toner 4 4 | Toner 5 4 |
|---|---|---|---|---|---|---|
| Optical Density | 1.35 | 1.26 | 1.41 | 0.95 | 1.1 | 1.32 |
| Background | 0.000 | 0.000 | 0.000 | 0.01 | 0.007 | 0.003 |
| Transfer Efficiency | 65% | 76% | 82% | 45% | 67% | 79% |
| Print Quality | Non-Uniform | Uniform | Uniform | Non-Uniform | Non-Uniform | Uniform |

0 digit at end means testing soon after production of toner, 4 digit at end means testing carried out after 4 months of storage.

Optical density of greater than 1.2 is considered acceptable, a background of less than 0.005 is considered acceptable, transfer efficiencies of greater than 75% is considered acceptable and uniform print quality is considered acceptable.

The results show that the toner with similar initial wax size to latex size is unacceptable (Toner 3). After 4 months of storage, Toner 4 also becomes unacceptable. Only Toner 5, which has the highest ratio of the latex size to wax size resulting in wax concentrated towards the center of the toner particle with large wax size, shows acceptable and consistent results.

Toner 6: Toner prepared as Toner 2 but with Latex, colorant, CCA and Wax mean sizes chosen arbitrarily from patent literature.

Toner 7: Toner prepared as Toner 6 but with Latex, colorant, CCA and Wax mean sizes in certain inter-related ratio to achieve the desired particle structure design.

Toner 7 showed better print performance than Toner 6.

Toner 8: Prepared in a similar manner to Toner 2 but using Latex 2. The particle density of Toner 8 was 1070 kg/m3 compared to 990 kg/m3 for Toner 2. The presence of the acrylic acid and methacrylic acid allowed the achievement of higher particle density as these components allowed the minimization of voids between nucleated and consolidated particles.

Toner 8 resulted in more flexibility in carrying out surface additive formulation to achieve the desired flow and charge properties.

Toner 9: Prepared in similar manner to Toner 8, except Latex 3 and Latex 4 were added in small portions (10 parts and 5 parts respectively). The particle density achieved was 1095 kg/m3. The nano-indentation value obtained was 25 nm. For Toner 8, the nano-indentation value was 200 nm.

Toner 8 and Toner 9 were formulated in the same manner. The SEM images showed that more flow additives were visible in Toner 9 than Toner 8—indicating that the flow additives had embedded relatively more into Toner 8 than Toner 9.

Toner 9 had a flow number of 94%, tribocharge of −9 microCoulomb per gram and surface coverage of 75%.

Toner 8 had a flow number of 83%, tribocharge of −5 microCoulomb per gram and surface coverage of 55%.

Print results also confirmed Toner 9 to be superior to Toner 8.

Toner 10: 6 parts wax and 2 parts CCA were mixed together with 22 liters of de-ionized water in a 50 Liter reactor containing proprietary agitator providing low shear uniform mixing. The dispersion was mixed at ambient temperature. The dispersion was then heated to the cloud point of the system surfactant to initiate nucleation (flocculation) . The nucleated mixture was held at this temperature for 1 hours to consolidate the formed initial particles. The mixture was cooled down to 25 C. 86 parts latex and 6 parts colorant were added to the reactor. The dispersion was mixed at ambient temperature. The dispersion was then heated to the cloud point of the system surfactant to initiate further nucleation (flocculation). The dispersion was then further heated to and held at a temperature higher than Tg to carry out shape and morphology control. Following this step the mixture was cooled, filtered, washed and dried to obtain dry toner powder. The toner was then blended with flow additives in a high energy blender to achieve a functional formulated toner. The resulting toner had a mean size of 8.7 microns (micrometer) with a ratio of the volume mean particle size (d50v) to number mean particle size (d50n) being 1.22.

Toner 11: 6 parts wax and 2 parts Colorant were mixed together with 22 liters of de-ionized water in a 50 Liter reactor containing proprietary agitator providing low shear uniform mixing. The dispersion was mixed at ambient temperature. The dispersion was then heated to the cloud point of the system surfactant to initiate nucleation (flocculation). The nucleated mixture was held at this temperature for 1 hours to consolidate the formed initial particles. The mixture was cooled down to 25 C. 86 parts latex, 2 parts CCA and 4 parts colorant were added to the reactor. The dispersion was mixed at ambient temperature. The dispersion was then heated to the cloud point of the system surfactant to initiate further nucleation (flocculation). The dispersion was then further heated to and held at a temperature higher than Tg to carry out shape and morphology control. Following this step the mixture was cooled, filtered, washed and dried to obtain dry toner powder. The toner was then blended with flow additives in a high energy blender to achieve a functional formulated toner. The resulting toner had a mean size of 8.6 microns (micrometer) with a ratio of the volume mean particle size (d50v) to number mean particle size (d50n) being 1.23.

Toners 10 and 11 were also tested in a commercially available printer. Following table shows the results:—

| | Optical Density | Background | Transfer Efficiency | Print Quality |
|---|---|---|---|---|
| Toner 10 | 0.9 | 0.07 | 57% | Non-Uniform |
| Toner 11 | 1.38 | 0.000 | 89% | Uniform |

The results show that even with the same composition and final toner physical properties, the locations of each component of wax, CCA, pigment and latex play big role in final print quality. Toner 10 has wax and CCA at the middle of toner particles. Toner 11 has wax and some colorant at the middle with latex, CCA and colorant uniformly forming outer layer. The print quality of toner 11, which was ideally structured, is significantly better.

While the present invention has been described with respect to certain preferred embodiments, it will be apparent to those skilled in the art that various changes and modifications may be made without departing from the scope of the invention as defined in the following claims.

I claim:

1. A method for producing a toner comprising at least four base materials: latex, wax, charge control agent (CCA), and colorant, comprising the steps of:

a. preparing stable dispersions of at least one of each base material wherein mean particle size of the base material is less than 1000 nm;

b. mixing the dispersions of step 'a' together wherein the particle size distribution among the base material particles are in predetermined ratios;

c. heating of the mixture of step 'b' for flocculation to a temperature up to the Tg of the base material latex;

d. optionally heating the above mixture above the Tg of the base material latex to consolidate the particles and control the shape of the particles; and e. obtaining toner particles, wherein said predetermined ratios of the particle size distribution among the base material particles are: latex to colorant, wax and CCA particle size distribution ratios are 0.1 to 1; colorant to latex, wax and CCA particle size distribution ratios are 10 to 1, 0.2 to 1, 0.2 to 1 respectively; wax to latex, colorant and CCA particle size distribution ratios are 10 to 1, 5 to 1 and 10 to 1 respectively; CCA to latex, colorant and wax particle size distribution ratios are 10 to 1, 5 to 1 and 0.1 to 1 respectively.

2. The method as claimed in claim 1 wherein said heating is by use of microwave radiation to control particle nucleation (aggregation).

3. The method as claimed in claim 1 wherein said stable dispersion of base material latex is prepared by emulsion polymerization to obtain the dispersion with determined molecular weight, molecular weight distribution, glass transition temperature, and melting point and characterized in precise particle size and particle size distribution.

4. The method as claimed in claim 1 wherein said base material latex has a mean particle size of 50 nm-500 nm and particle size distribution (d90/d10) of 1.5-10.

5. The method as claimed in claim 1 wherein at least one of said base material latex or colorant or wax or charge control agent is of more than one type.

6. The method as claimed in claim 1 wherein said stable dispersion of base material colorant is prepared by media milling or use of high pressure homogenizer.

7. The method as claimed in claim 1 wherein said base material colorant has particle size of 50 nm-1000 nm and particle size distribution (d90/d10) of 1.5-12.

8. The method as claimed in claim 1 wherein said stable dispersion of base material wax is prepared by emulsification of melted wax by an aqueous mixture or by melting the wax in the presence of an emulsifier in an aqueous environment and passage through a high pressure homogenizer.

9. The method as claimed in claim 1 wherein said base material wax has particle size of 100 nm-2000 nm and particle size distribution (d90/d10) of 1.5-15.

10. The method as claimed in claim 1 wherein said stable dispersion of base material charge control agent is prepared by use of a high pressure homogenizer.

11. The method as claimed in claim 1 wherein said base material charge control agent has particle size of 50 nm-1000 nm and particle size distribution (d90/d10) of 1.5-15.

12. The method as claimed in claim 1 wherein said toner particles obtained in step 'e' in claim 1 have mean size of 5 to 10 micron.

13. The method as claimed in claim 1 further comprising the optional steps of a. filtering and washing of the toner particles;

b. drying said toner particles; and c. blending flow additives and/or modifying surface morphology and/or charge control and screening.

14. The method as claimed in claim 4 wherein said base material latex has a mean particle size of 50 nm -150 nm and particle size distribution (d90/d10) of 1.5-4.

15. The method as claimed in claim 7 wherein said base material colorant has particle size of 50 nm -350 nm and particle size distribution (d90/d10) of 1.5-4.

16. The method as claimed in claim 9 wherein said base material wax has particle size of 100 nm-1000 nm and particle size distribution (d90/d10) of 2-10.

17. The method as claimed in claim 11 wherein said base material charge control agent has particle size of 50 nm-350 nm and particle size distribution (d90/d10) of 1.5-4.

18. The method as claimed in claim 1 wherein said toner particles obtained in step 'e' in claim 1 have mean size of 6 to 9 microns.

* * * * *